US006155796A

United States Patent [19]

Schmalz et al.

[11] Patent Number: 6,155,796

[45] Date of Patent: Dec. 5, 2000

[54] EJECTOR FOR GENERATING NEGATIVE PRESSURE

[75] Inventors: Kurt Schmalz; Wolfgang Schmalz, both of Dornstetten; Hans Dittmann, Glatten, all of Germany

[73] Assignee: J. Schmalz GmbH, Glatten, Germany

[21] Appl. No.: 09/293,889

[22] Filed: Apr. 19, 1999

[30] Foreign Application Priority Data

Apr. 18, 1998 [DE] Germany ..... 198 17 249

[51] Int. Cl.[7] ..... F04B 5/48

[52] U.S. Cl. ..... 417/187; 417/186; 417/182

[58] Field of Search ..... 417/186, 187, 417/182

[56] References Cited

U.S. PATENT DOCUMENTS 4,432,701 2/1984 Ise ..... 417/187
4,549,854 10/1985 Yamamoto ..... 417/187
4,861,232 8/1989 Ise et al. ..... 417/76

FOREIGN PATENT DOCUMENTS

3818380A1 12/1988 Germany .

*Primary Examiner*—Charles G. Freay
*Assistant Examiner*—Timothy P. Solak
*Attorney, Agent, or Firm*—Jones, Tullar & Cooper, P.C.

[57] ABSTRACT

The present invention relates to an ejector for generating negative pressure having a pressure connection discharging into a propellant nozzle, and having a suction connection which discharges via a suction conduit into a receiver nozzle. The propellant nozzle and the receiver nozzle are provided in a suction valve with a first blocking piston for the propellant nozzle. A work conduit communicating with the pressure connection and a control conduit communicating with the pressure connection are provided and a blow conduit discharging via a blow valve into the suction connection communicates with a second blocking piston, and the piston position of the second blocking piston of the blow valve being triggerable via the control conduit.

15 Claims, 3 Drawing Sheets

EJECTOR FOR GENERATING NEGATIVE PRESSURE

FIELD OF THE INVENTION

The present invention relates to an ejector for generating negative pressure, in particular in negative-pressure manipulating devices, having a pressure connection discharging into, or connected to, a propellant nozzle, and having a suction connection which discharges via a suction conduit into a receiver nozzle, wherein the propellant nozzle and the receiver nozzle are provided in a suction valve.

BACKGROUND OF THE INVENTION

Such ejectors are known for instance from German Patent DE 43 02 951 C1. Such ejectors operate on the Venturi principle. The filtered, lubricant-free compressed air flows into the ejector via a connection neck and reaches the propellant nozzle, where the flow velocity of the air acting as a propellant gas is exceeded to supersonic speed in the cross-sectional reduction. After emerging from the propellant nozzle, the air expands and flows via a receiver nozzle into the expansion portion and from there out into the open, optionally via a muffler. In the process, a negative pressure is created in the chamber surrounding the propellant nozzle, and this causes air to be aspirated via the suction connection. The aspirated air and the propellant gas introduced into the ejector emerge jointly into the open via the expansion portion.

Ejectors of this kind have the advantage over vacuum pumps of not having any rotating parts and therefore of requiring little maintenance. They also have low wear. They are also explosion-proof, since as a rule they are pneumatic in nature. Furthermore, they are simple in design and can be installed in an arbitrary position.

Also, they develop no heat and can be turned on and off at any time, which saves energy. In addition, the vacuum can be built up faster because of short line lengths between suction cups and the ejector. Finally, the compact design, low weight, and the possibility of combining multiple functions in one device, along with economies in the area of construction, work preparation, procurement, mechanical machining, installation, startup, and spare parts inventory, all play important roles.

For fast decay of the vacuum and ejection of the workpiece, in special ejectors the suction connection can be occupied by compressed air, so that an overpressure is applied to the workpiece instead of a negative pressure. However, it has been found that above all when there are high resistances in the suction connection, especially with long connecting lines between the ejector and a suction cup, for instance, engaging the workpiece, the compressed air does not escape, or only a negligible portion of it escapes, via the suction connection and instead it escapes through the receiver nozzle via the suction conduit. In other words, a pneumatic short circuit is created. The attempt has been made to overcome this disadvantage with check valves, but this has led to unsatisfactory results.

SUMMARY OF THE INVENTION

An object of the present invention is therefore to furnish an ejector in which the vacuum that has been built up can be rapidly made to decay and the workpiece, aspirated by a suction cup, for instance, can easily be ejected by compressed air.

In an ejector of the type defined at the outset, this object is attained according to the present invention in that the suction valve has a first blocking piston for the propellant nozzle; that a work conduit communicating with the pressure connection and a control conduit communicating with the pressure connection are provided; that via a blow valve a blow conduit discharging into, or connected to, the suction connection communicates with a second blocking piston; and that the piston position of the second blocking piston of the blow valve is triggerable via the control conduit.

The ejector of the present invention has in addition to the suction valve a blow valve as well, which communicates with the pressure connection via a work conduit and a control conduit and with the suction connection via a blow conduit. In its open position, the blow valve connects the work conduit to the blow conduit, so that the compressed air prevailing in the work conduit can be transferred to the blow conduit and can emerge from the suction connection. With the blow valve closed, the blow conduit is free of compressed air. In this way, the suction connection can be supplied with either negative pressure or compressed air without difficulty. Thus the vacuum can be rapidly undone and the workpiece can be ejected.

A further feature of the present invention provides that the control conduit discharges into, or is connected to, the blow valve via a suction control valve that opens and blocks the control conduit. Via this suction control valve, the blow valve is triggered in such a way that either the negative pressure or the compressed air prevails at the suction connection. The suction control valve can be operated electrically, pneumatically or hydraulically and can for instance be integrated into a control unit of a production machine.

A preferred exemplary embodiment provides that when the control conduit is open, the second blocking piston of the blow valve assumes its closing position and closes the blow conduit. This is the case for instance when the suction control valve assumes its position of repose. The blowoff, or in other words, the application of an overpressure to the suction connection accordingly takes place only whenever the suction control valve is triggered in a targeted way and converted to its working position. This is an important safety feature, since the workpiece can be ejected only on request, or in other words, intentionally. Even if there is some malfunction of the apparatus or a power failure, the negative pressure continues to prevail at the suction connection for a certain length of time, and the workpiece continues to be firmly held.

Advantageously, the suction conduit and/or the receiver nozzle is closable via a third blocking means, in particular a blocking piston. This third blocking piston comes into action, or in other words, the suction conduit is closed via this third blocking piston, whenever an overpressure is intended to prevail at the suction connection. In one exemplary embodiment, the second and third blocking pistons are actuated then, or in other words, the second blocking piston is transferred to its open position and the third blocking piston is transferred to its closing position. Preferably, these occur at the same time. Instead of a blocking piston, a flap or a slide can also be used. The possibility exists also of closing not the suction conduit but rather the receiver nozzle. This should also be understood to mean the closure of the outlet of the suction valve.

A further feature provides that the control conduit discharges into, or is connected to, the suction valve and/or into a third valve having a third blocking piston, via a blow control valve that opens or blocks the control conduit. With the control conduit open via the blow control valve, the first blocking piston of the suction valve and/or the third blocking piston of the third valve then assumes its closing position, as a result of which the propellant nozzle or the suction conduit, respectively, is closed. Via this blow control valve, the negative pressure generation is turned off, and by means of the blocking pistons the propellant nozzle and the third valve, and thus the suction conduit, are closed.

According to the present invention, the piston position of the first and/or second and/or third blocking piston can be triggered via the work conduit. Thus, if an overpressure is applied to the pressure connection, the blocking pistons then assume their positions for aspirating a workpiece. The blow control valve is preferably embodied such that in the position of repose it interrupts or blocks the control conduit to the first and third blocking pistons.

One embodiment provides that the first and/or second and/or third blocking piston in the position of repose are held in a closing position by the force of a spring. When the ejector is without pressure, the blocking pistons are in their position of repose and block or close the corresponding valves.

In a preferred exemplary embodiment, the suction. control valve and the blow control valve are triggerable only in alternation. Thus no undefined switching states can occur.

Preferably, the flow cross section of the blow conduit is adjustable. The adjustment can be done for instance by means of an adjusting screw protruding into the flow cross section. The pressure of the blown air and/or its quantity for undoing the negative pressure and ejecting the aspirated article can be adapted in this way exactly to the indexing times, the special workpiece, safety requirements, and so forth.

Preferably, the suction control valve and/or the blow control valve can be triggered electrically, pneumatically or hydraulically. It is therefore possible to integrate the ejector into machine control systems without problems.

One exemplary embodiment provides that the ejector has a housing, which receives the conduits and the blocking pistons, and on which a blow control valve and a suction control valve can be mounted. This modular design enables optimal adaptation of the ejector to existing conditions, such as indexing times, the magnitude of the negative pressure, the volume to be pumped out, the type of triggering of the control valves, etc.

Further advantages, characteristics and details of the present invention will become apparent from the dependent claims and the ensuing description, in which several exemplary embodiments of the present invention are shown in detail. The characteristics shown in the drawing, mentioned in the description and recited in the claims can each be essential to the present invention individually or in any arbitrary combination.

DESCRIPTION OF THE PREFERRED EMBODIMENT

Figure 1:
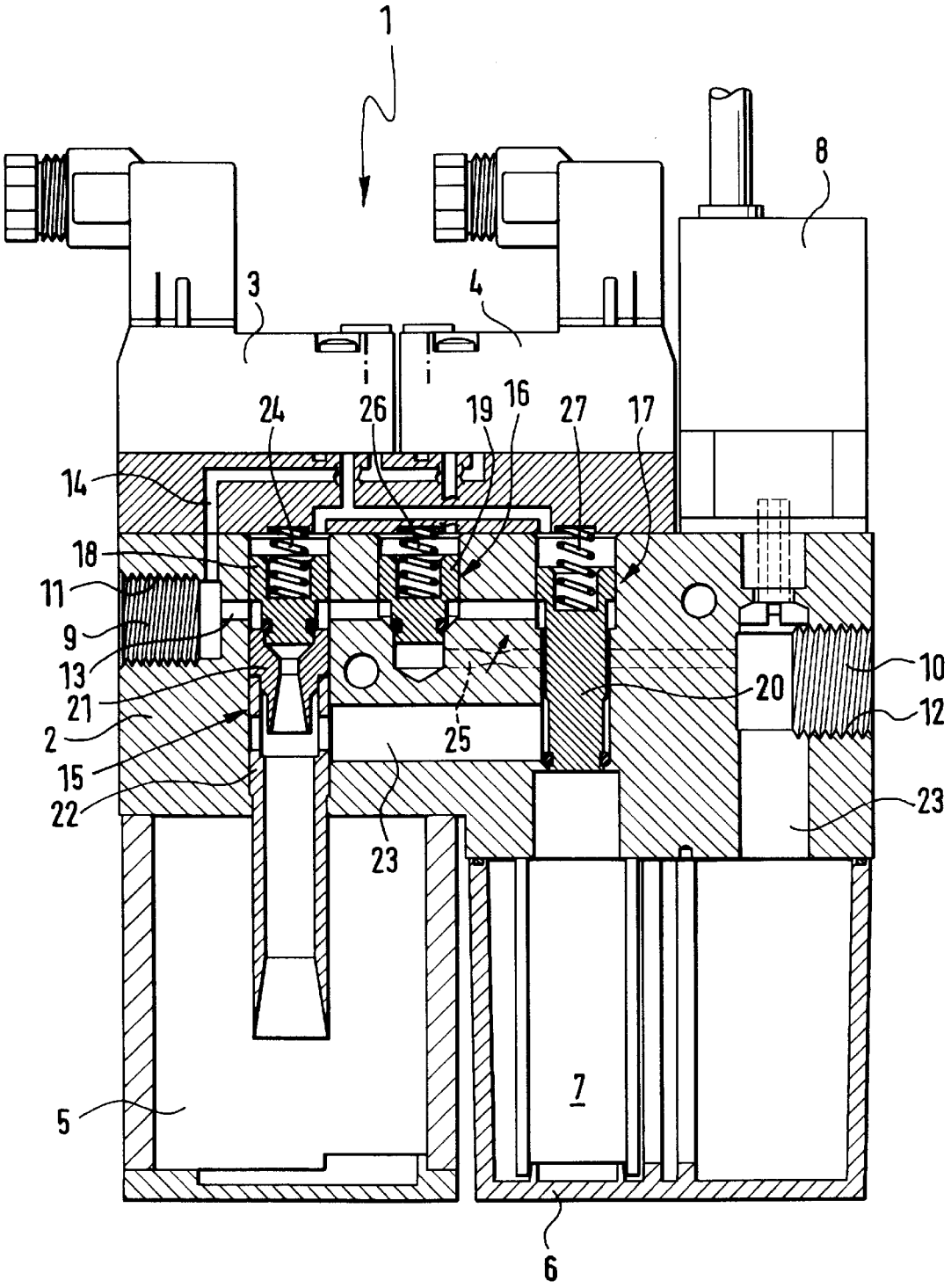
FIG. 1, is a cross section through the ejector of the present invention in its position of repose.

In FIG. 1, a preferred exemplary embodiment of an ejector, identified overall by reference numeral 1, is shown which has an ejector housing 2, a suction control valve 3, a suction control valve 4, a muffler 5, a filter housing 6 with a filter element 7, and a pressure sensor 8. The ejector housing 2 has a pressure connection 9 and a suction connection 10, which are each provided with a female thread 11, 12 so that pneumatic lines can be connected to them. Discharging into, or connected to, the pressure connection 9 are both a work conduit 13 and a control conduit 14, which are both supplied with compressed air. Via the work conduit 13, a control valve 15, a blow valve 16, and a third valve 17 communicate with one another. In the valves 15, 16 and 17, blocking pistons 18, 19 and 20 are disposed as blocking means. In the position of repose, which is shown in FIG. 1, the valves 15, 16 and 17 assume their closing position, in which the blocking pistons 18, 19 and 20 close the valves 15, 16 and 17.

The suction valve 15 has a propellant nozzle 21 and a receiver nozzle 22; the propellant nozzle 21 discharges into, or is connected to, the receiver nozzle. Between the propellant nozzle 21 and the receiver nozzle 22, a suction conduit 23 discharges into, or is connected to, the suction valve 15, the suction conduit communicating with the suction connection 10 via the filter element 7. The blocking piston 18, in its position of repose, is disposed coaxially to the propellant nozzle 21 and closes the propellant nozzle. The blocking piston 18 is held in this position of repose via a compression spring 24 when the ejector 1 is without pressure. The blocking piston 19 of the blow valve 16, when the ejector 1 is without pressure, is also in its position of repose, in which it closes the blow valve 16 and thus interrupts or blocks a communication of a blow conduit 25 with the work conduit 13. The blow conduit 25 discharges directly into the suction connection 10 and, when the blow valve 16 is open, makes a connection, through the adjustable flow control 40, between the pressure connection 9 and the suction connection 10. The blocking piston 19 is held in this position of repose via a compression spring 26 when the ejector 1 is without pressure. The blocking piston 20 of the third valve 17 is likewise in its position of repose when the ejector 1 is without pressure; in this position, it closes the third valve 17 and thus interrupts the suction conduit 23. When the ejector 1 is without pressure, the blocking piston 20 is kept in this position of repose via a compression spring 27.

Figure 2:
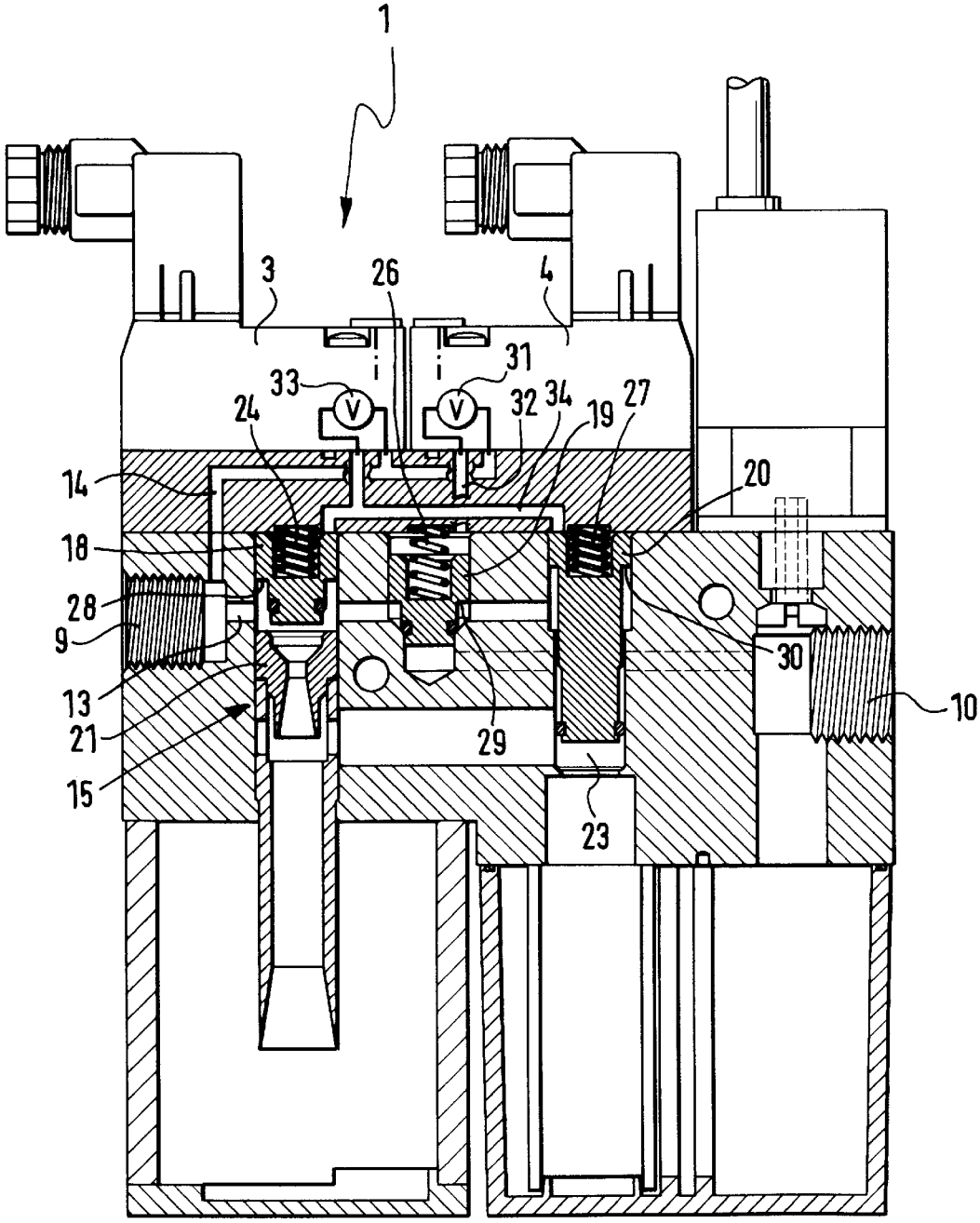
FIG. 2, is a cross section through the ejector of the present invention when a negative pressure is generated.

FIG. 2 shows the ejector 1 of FIG. 1 in the suction position; identical elements are identified by the same reference numerals. An overpressure prevails at the pressure connection 9 and supplies the work conduit 13 and the control conduit 14 with compressed air. The blocking pistons 18, 19 and 20 each have a respective annular shoulder 28, 29 and 30, where the overpressure prevails in each case. Because of the effective surface area of the annular shoulders 28, 29 and 30, the overpressure exerts a force on the blocking pistons 18, 19 and 20 that is counter to the spring forces of the compression springs 24, 26 and 27, and in other words, is exerted in the direction of the open position of these blocking pistons 18, 19 and 20.

In the suction position of the ejector 1, the suction control valve 3 furthermore assumes an open position, in which the control conduit 14 communicates, via an electromechanically actuatable valve 31 which assumes its open position, with a conduit 32. This conduit 32 discharges into, or is connected to, the chamber in the blow valve 16 that receives the compression spring 26. In this way, the overpressure also prevails on the side opposite the annular shoulder 29, and so by the force of the compression spring 26, the blocking piston 19 remains in the closing position and disconnects the blow conduit 25 from the work conduit 13.

The blow control valve 3 also has a valve 33, which in the suction position of the ejector 1 assumes its closing position and disconnects the work conduit 13 from a conduit 34. This conduit 34 discharges into, or is connected to, the chamber of the valves 18 and 20 that receives the compression springs 24 and 27. Ambient pressure prevails in the conduit 34, so that the blocking pistons 18 and 20 are forced into the open positions by overpressure acting on the annular shoulders 28 and 30 counter to the force of the compression springs 24 and 27 and thus uncover the propellant nozzle 21 and the suction conduit 23. Via the compressed air flowing through the suction valve 15, a negative pressure is generated in a known way in the suction conduit 23, and air is aspirated via the suction connection 10.

Figure 3:
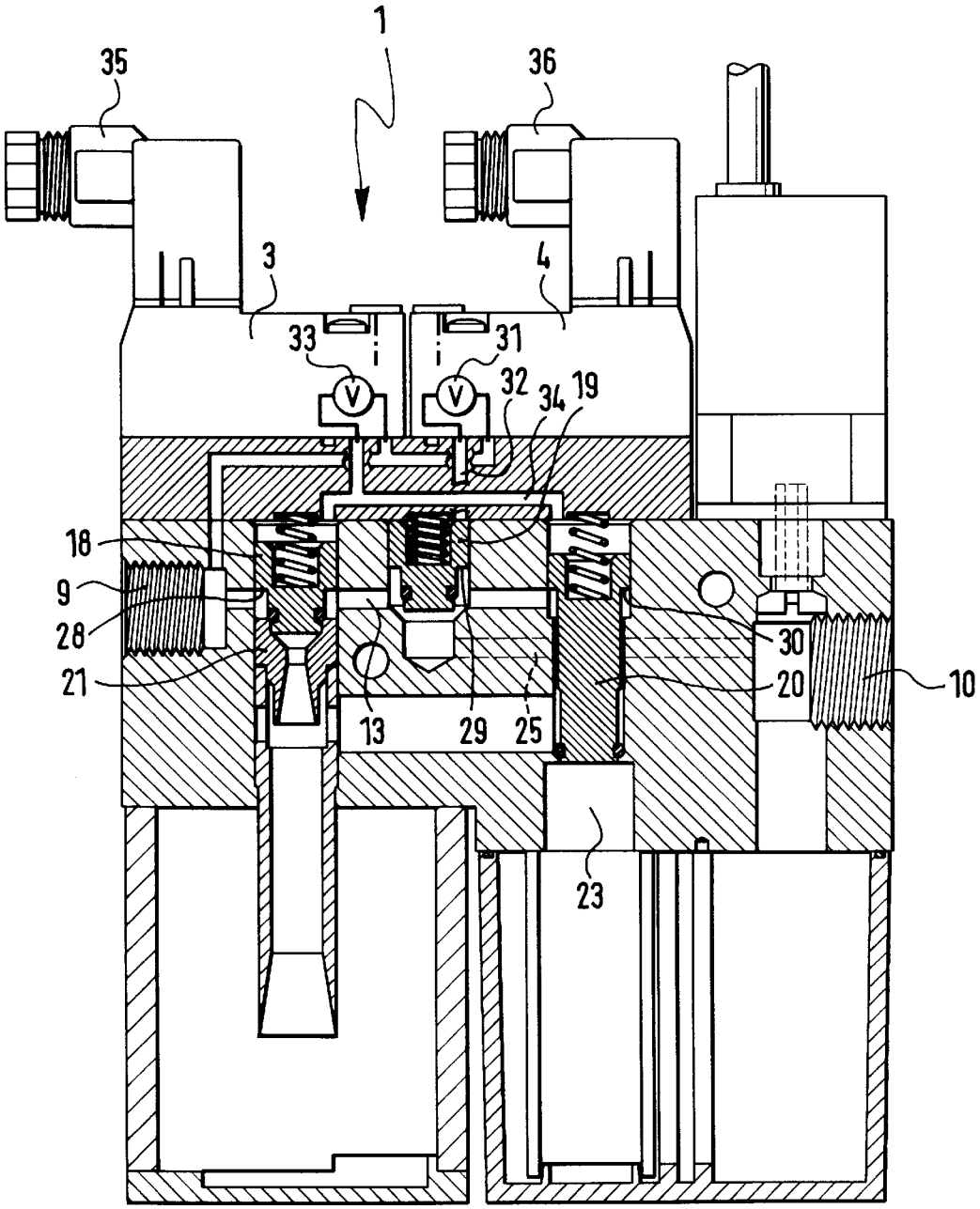
FIG. 3, is a cross section through the ejector of the present invention upon blowoff.

FIG. 3 shows the ejector 1 of FIG. 1 in the blowing position. In this position, as before, an overpressure prevails at the pressure connection 9. However, by suitable triggering, the valve 31 of the suction control valve 4 is in its closing position, while the valve 33 of the blow control valve 3 is in its open position. As a result, the conduit 34 is acted upon by overpressure, which prevails at the annular shoulders 28 and 30 of the blocking pistons 18 and 20. Thus by the forces of the compression springs 24 and 27, the blocking pistons 18 and 20 are forced into the closing position, and as a result the propellant nozzle 21 and the suction conduit 23 are closed. Since ambient pressure prevails in the conduit 32, the blocking piston 19 is moved counter to the force of the compression spring 26 into its open position, so that communication is established between the work conduit 13 and the blow conduit 25. Since an overpressure prevails at the work conduit 13, compressed air is blown out of the suction connection 10 via the blow conduit 25. This compressed air can leave the ejector 1 only through the suction connection 10, since the suction conduit 23 is closed by the blocking piston 20.

The possibility also exists, with the valve 31 or 33 closed, to connect the conduit 32 or 34 with the ambient air or vent it, so that any overpressure prevailing there is rapidly reduced. The valves 3 and 4 have connections 35 and 36, by way of which they can be connected to (electric, pneumatic or hydraulic) control lines.

It should also be noted that the blocking piston 20, both in operation with automatic air-economizing systems and in the event of an energy failure, assumes the function of a check valve and prevents a sudden collapse of the vacuum in the system by closing the suction conduit 23.

What is claimed is:

1. An ejector for generating a negative pressure, comprising:

a housing having a pressure connection and a suction connection;

work conduit and a control conduit both connected to said pressure connection;

a suction conduit and a blow conduit both connected to said suction connection; and a suction valve connected to said work conduit and a blow valve connected to said blow conduit, wherein said suction valve includes a first blocking piston, a propellant nozzle and a receiver nozzle, said first blocking piston engaging said propellant nozzle, and said blow valve includes a second blocking piston communicating with said blow conduit and triggerable using said control conduit.

2. The ejector as defined in claim 1, further comprising:

a suction control valve which opens and closes said control conduit.

3. The ejector as defined in claim 1, wherein in the open position of said suction control valve, said second blocking piston closes said blow conduit.

4. The ejector as defined in claim 1, further comprising:

a third blocking piston for closing and opening said suction conduit.

5. The ejector as defined in claim 1, further comprising:

a third blocking piston for closing and opening said receiver nozzle.

6. The ejector as defined in claim 1, further comprising:

a third blocking piston for closing and opening said suction conduit and said receiver nozzle.

7. The ejector as defined in claim 1, further comprising:

a third valve having a third blocking piston; and a blow control valve which opens and blocks said control conduit, wherein said control conduit discharges into one of said suction valve, said third valve and said suction valve and said third valve via said blow control valve.

8. The ejector as defined in claim 1, wherein when said control conduit is open via said blow control valve, one of said first blocking piston, said third blocking piston, and said first blocking piston and third blocking piston assumes its closed position and closes one of said propellant nozzle, said suction conduit, and said propellant nozzle and said suction conduit, respectively.

9. The ejector as defined in claim 7, wherein one of: said suction control valve, said blow control valve, and said suction control valve and said blow control valve are triggered by one of electrical, pneumatic and hydraulic means.

10. The ejector as defined in claim 7, further comprising:

a suction control valve, and wherein said suction control valve and said blow control valve are triggered alternatively.

11. The ejector as defined in claim 1, wherein the position of one of: said first blocking piston, said second blocking piston, said third blocking piston, said first and second blocking pistons, and said first, second and third blocking pistons are triggered using said work conduit.

12. The ejector as defined in claim 1, further comprising:

a spring associated with each blocking piston, and wherein said first blocking piston, said second blocking piston and said third blocking piston are held closed by their respective associated spring.

13. The ejector as defined in claim 1, further comprising:

means for adjustably controlling the flow cross section of said blow conduit.

14. The ejector as defined in claim 1, further comprising:

a blow control valve and a suction control valve are mounted to said housing, said blow control valve and said suction control valve each having a conduit connecting them to said control conduit, wherein said work conduit, said control conduit, said suction conduit, said blow conduit, said conduits connecting said blow control valve and said suction control valve to said control conduit, and said first, second and third blocking pistons are all located in said housing.

15. An ejector for generating a negative pressure, comprising:

a housing having a pressure connection and a suction connection;

a work conduit and a control conduit both connected to said pressure connection;

a suction conduit and a blow conduit both connected to said suction connection;

a suction valve connected to said work conduit and a blow valve connected to said blow conduit; and a spring associated with each blocking piston, wherein said suction valve includes a first blocking piston, a propellant nozzle and a receiver nozzle, said first blocking piston engaging said propellant nozzle, and said blow valve includes a second blocking piston communicating with said blow conduit and triggerable using said control conduit, and wherein said first blocking piston, said second blocking piston and said third blocking piston are held closed by their respective associated spring.

* * * * *